United States Patent [19]

Hiljanen

[11] Patent Number: 5,003,224

[45] Date of Patent: Mar. 26, 1991

[54] METHOD AND A DEVICE FOR REPLACING INCANDESCENT FILAMENTS, AND A LAMP WITH SEVERAL FILAMENTS

[76] Inventor: Jorma Hiljanen, Hedelmatarhantie 3B58 SF-15860, Kartano, Finland

[21] Appl. No.: 368,315

[22] PCT Filed: Sep. 23, 1988

[86] PCT No.: PCT/FI88/00153

§ 371 Date: Jun. 28, 1989

§ 102(e) Date: Jun. 28, 1989

[87] PCT Pub. No.: WO89/03119

PCT Pub. Date: Apr. 6, 1989

[30] Foreign Application Priority Data

Sep. 23, 1987 [FI] Finland ..... 874165

[51] Int. Cl.[5] ..... H01J 7/44

[52] U.S. Cl. ..... 315/65; 315/68; 315/88

[58] Field of Search ..... 315/65, 67, 68, 88, 315/89, 90

[56] References Cited

U.S. PATENT DOCUMENTS

| | | | |
|---|---|---|---|
| 2,874,331 | 2/1959 | Otto | 315/68 |
| 4,034,259 | 7/1977 | Schoch | 315/88 |
| 4,080,548 | 3/1978 | Johnson | 315/68 |
| 4,382,209 | 5/1983 | Loucaides | 315/65 |
| 4,527,095 | 7/1985 | Herring | 315/65 |
| 4,767,968 | 8/1988 | Geanous | 315/88 |
| 4,841,196 | 6/1989 | Waymouth | 315/65 |
| 4,862,038 | 8/1989 | Morten | 315/88 |

*Primary Examiner*—Eugene R. LaRoche
*Assistant Examiner*—Amir Zarabian
*Attorney, Agent, or Firm*—Kenyon & Kenyon

[57] ABSTRACT

An automatic replacement circuit is provided for the replacement of burnt-out filaments as well as a method for implementing the replacement of incandescent filaments. The replacement circuit includes a pulse generator which operates independently of the activated filament to feed continuous feed pulses to a counter circuit while a separate resetting pulse circuit delivers resetting pulses to the counter unit in dependence on the current flowing through the filament. The resetting pulses cancel the feed pulses. In the absence of resetting pulses, the feed pulses accumulate and upon reaching a predetermined amount, trigger a trigger selector circuit for activating the next filament.

18 Claims, 3 Drawing Sheets

Figure 1:
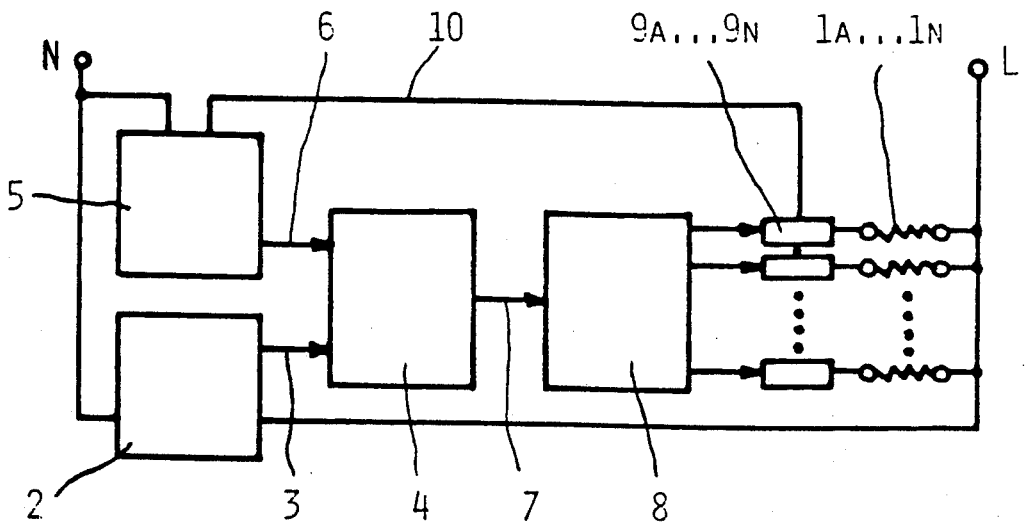

METHOD AND A DEVICE FOR REPLACING INCANDESCENT FILAMENTS, AND A LAMP WITH SEVERAL FILAMENTS

The invention relates to a method for supervising the function of the incandescent filament in connection with one or several incandescent lamps, which method comprises electronic controlled automatic replacing of a burnt-out filament for a new one. The invention also relates to a circuit for the automatic replacement of filaments, and an incandescent lamp with several filaments.

In connection with incandescent filaments or the like there is the problem, that the service life of the individual incandescent filament is relatively limited. When a filament, due to the transfer of metal, has burned out the whole lamp must be replaced. This causes economical loss, because, in theory, only a substitution of the filament would be necessary, while other parts of the lamp, like the glass bulb and the gas filling could be utilized during a longer time. Provided with a new incandescent filament, the same lamp could serve until the transfer of metal from the incandescent filaments to the glass bulb gradually would cause a considerable loss of luminance. With the use of halogen gas, this transfer of metal to the glass can also be effectively prevented, but the transfer of metal from the filament irretrievable, results in some filament spots being thinner than the rest of the filament, at which spots the filament will burn through.

The replacement itself of a burnt-out lamp is no problem when the lamp is in an easily accessible place. A lamp is, however, often situated in a rather difficult place, and then the cost of the labour needed for the replacement is greater than the value of the lamp itself. Further, a lamp often may be in such a use, that its light going out may cause inconvenience or even danger.

In order to avoid these inconveniencies a method according to the invention is developed for replacing an incandescent filament. In addition, an automatic replacement circuit and a lamp with several incandescent filaments are provided for utilizing this method.

Thus in accordance with the method, a pulse generating means independent of the function of the incandescent filament are made, for each case respectively, to continually feed pulses to reference means having a certain storage capacity, which pulse storage is continually emptied by signals from detecting means dependent upon the function of the incandescent filament. Any lack of such signals, e.g. due to a burn-out of the incandescent filament, will make the reference means full, which in turn will cause the reference means to give a control signal to means arranged for replacing the incandescent filament.

According to a preferred embodiment of the invention a 0-voltage circuit is used as a pulse generating means, which at each 0-point of an alternating current gives a pulse to counting means working as a reference means, and which continuously is emptied by a resetting pulse circuit detecting the current passing through the incandescent filament, the counting means will fill up, and will give a signal to a trigger/selector circuit working as the means for changing said filament, and which in turns switches on connecting means arranged for each of the several filaments. According to one embodiment of the invention, triac-semiconductor means are preferably used as the connecting means for each filament.

For the automatic replacement circuit according to the invention it is characteristic, that the circuit comprises a continuously working pulse generator, which is independent of the function of the incandescent filaments, and a continuously working resetting pulse circuit, which is dependent on the function of the filaments, and further means for comparing the pulses from the pulse generators, having means for replacing filaments connected thereto.

The lamp according to the invention comprises a common socket and at least one transparent closed shell connected thereto, having within the shell a gas for the protection of each respective incandescent means ignited on any occasion. According to the invention, the incandescent means of the lamp comprise several incandescent filaments, which preferably are used one at a time respectively, and which suitably are connected at one end to a common terminal. The other end of each shunt arranged filament is connected to the automatic replacement means arranged e.g. in the socket of the lamp. The replacement means connecting, in the manner described above, a new incandescent filament into operation when the previously working filament has burned out or ceased to work for any other reason.

Figure 4:
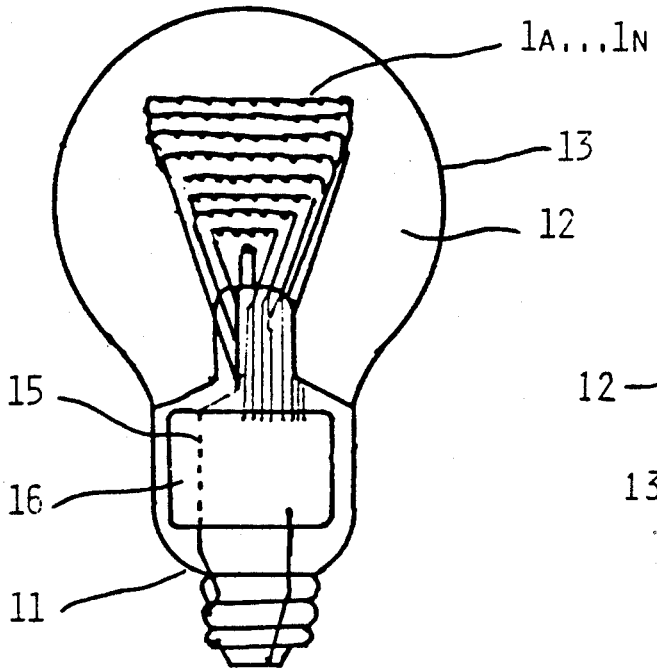
Figure 5:
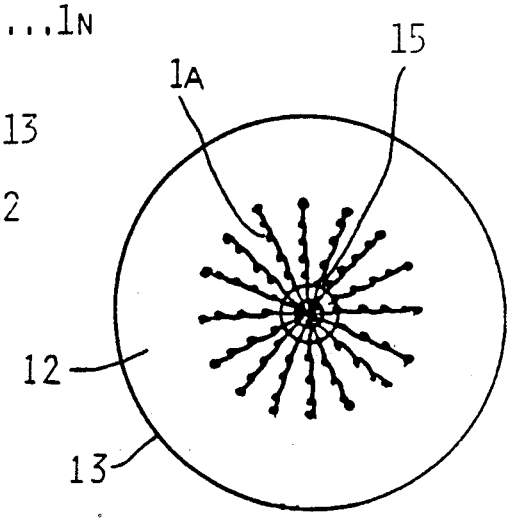
Figure 2:
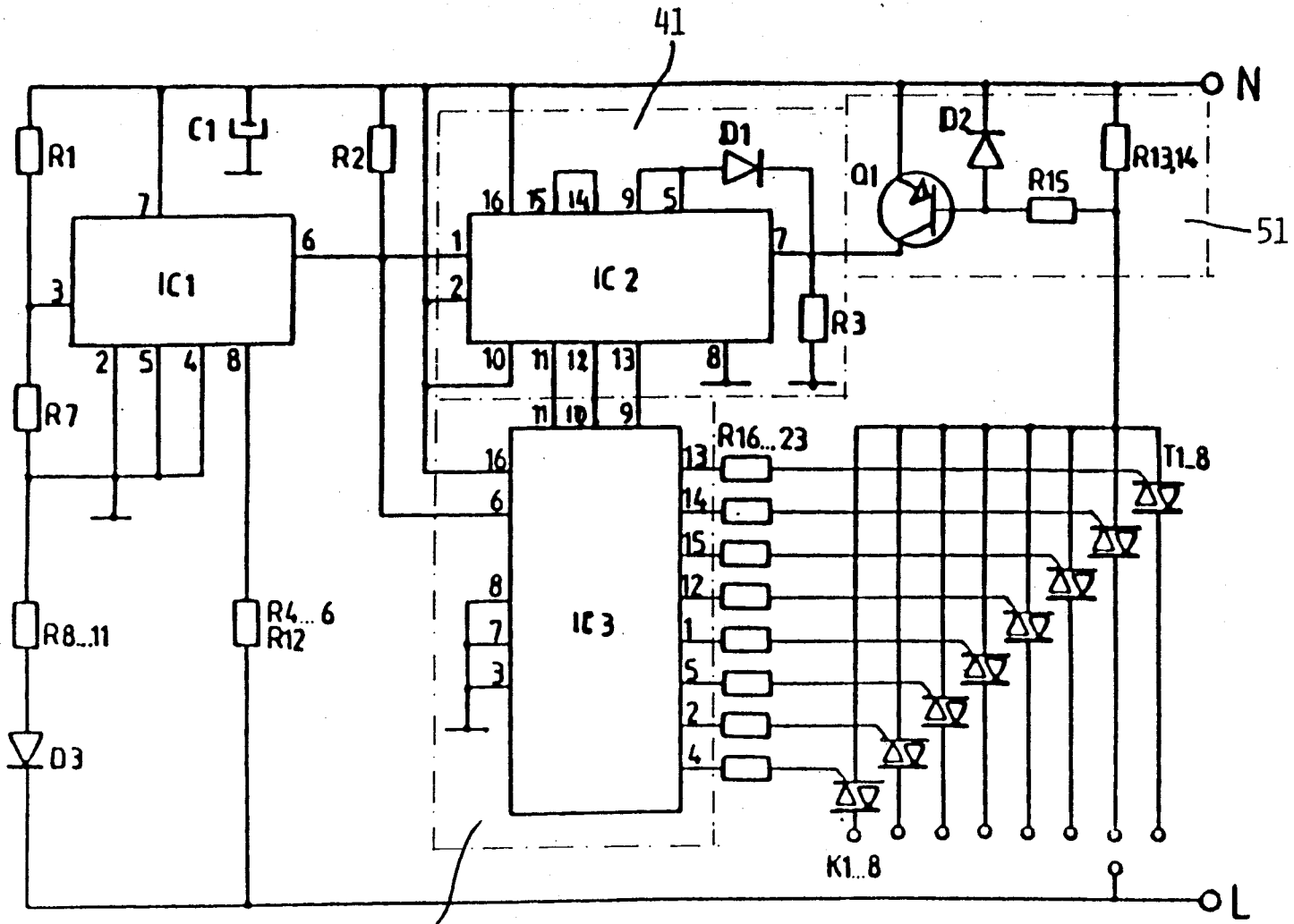
Figure 3:
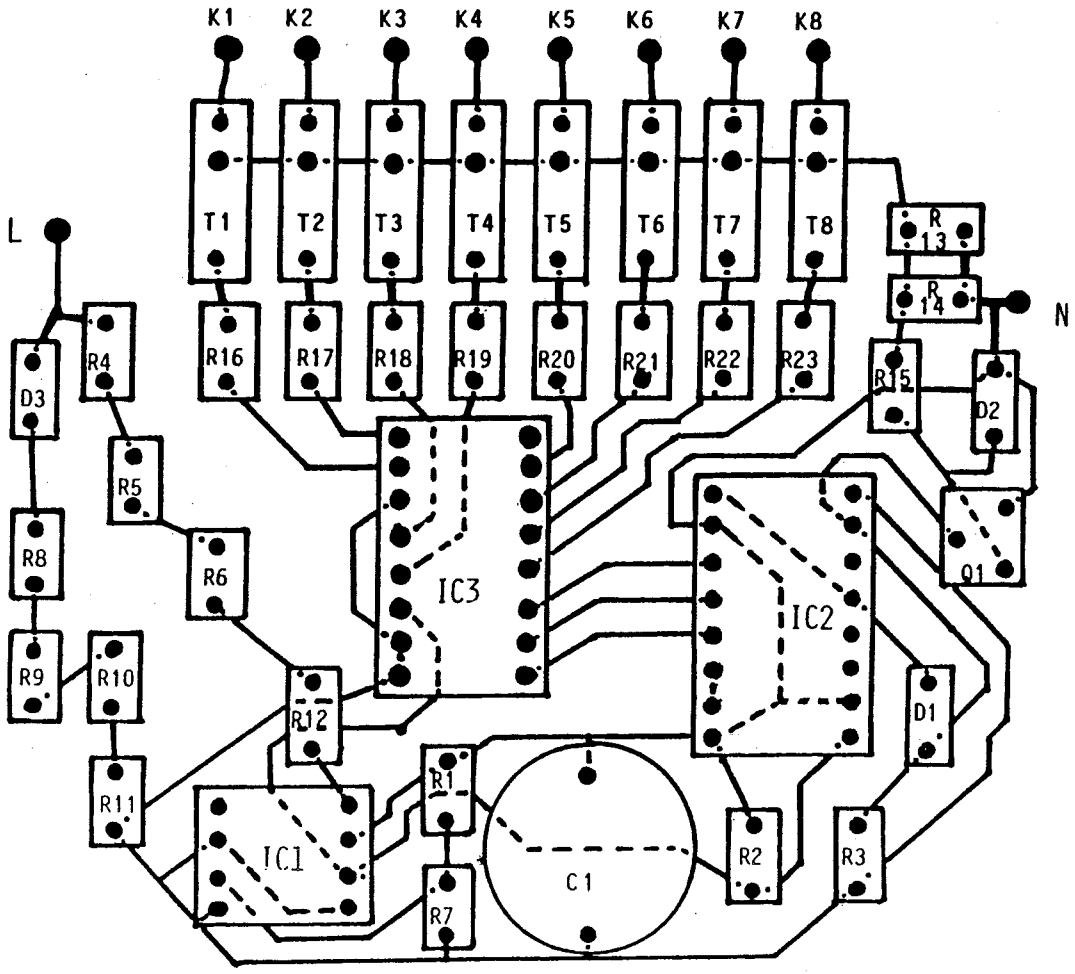

Now the invention will be discussed in more detail with reference to the enclosed drawings, where:

FIG. 1 shows a schematic view of the circuit according to the invention,

FIG. 2 discloses in detail the circuit diagram for an embodiment of the invention, said embodiment having 8 incandescent filaments, FIG. 3 shows a physical design of the circuit according to FIG. 2, FIG. 4 shows a lamp with several incandescent filaments according to one embodiment of the invention, and FIG. 5 shows an alternative embodiment of a multi-filament lamp seen from above.

In the block diagram according to FIG. 2 the working principle of the invention is generally shown. The figure discloses incandescent filaments 1*a*. . . 1*n* of a practically arbitrary number. The number of the filaments is principally restricted only by the number which technically can be fitted into one lamp. The central part of the automatic replacement device is the reference (see FIG. 1), which in the embodiments according to FIGS. 2 and 3 is shown as a CMOS logic circuit IC2, e.g. of the type MC14520B, working as a counter. The counter receives regular 0-pulses from a pulse generator 2 and simultaneously, when one of the incandescent filaments 1*a*. . . 1*n* is working, resetting pulses 6 from a detecting means 5.

The pulse generator 2, which in the embodiment according to FIGS. 2 and 3 is shown as a zero voltage switch IC1, e.g. of the type UAA 10168, works essentially independently of the incandescent filaments when the power is on, and feeds pulses 3 to the reference means 4 at the rate of the alternating current. In the embodiment according to FIGS. 2 and 3 the zero voltage switch IC1 gives voltage/trigger pulses at every zero point in the alternating current.

When a filament is working a current 10 will pass, simultaneously with the pulses 3, through a resetting circuit 5 working as a detecting means. When a filament is working, the resetting circuit, which in the embodiments according to FIGS. 2 and 3 is shown as a resetting pulse circuit 51, also continuously feeds resetting pulses 6 to the reference means 4. Thus the reference means 4, or a counter 41 working as one, will be continuously emptied in spite of the continuous pulses 3 from said pulse generator 2, and will hence not give any control signal showing essential unbalance between signals 3 and 6, i.e. any signal 7 urging a change of filament being sent to filament replacement means 8.

In the embodiment according to FIGS. 2 and 3 the resetting pulse circuit 51 is shown as a circuit comprising a transistor Q1 (e.g. of the type MMST 3906) and resistors R13, R14 and R15 (e.g. metal film resistors of the type MCR18J-2R2, -2R2 and -680R). The circuit generates pulses in every second (negative) half cycle, and will thus see to a frequent enough resetting of the counter 41 (IC2), which cannot then be filled as long as a current 10 through any of the filaments 1*a*. . . 1*n* flows through the circuit.

When a filament 1*a*. . . 1*n*-1 in use ceases to work, the current 10 through the detecting means 5 will be interrupted. The resetting signal 6, which until then was essentially continuously given, will cease, and the reference means 4, in the embodiment shown as the counter 41, will gradually be filled with signals 3 from the continuously working pulse generator 2 up to a predetermined amount. Then, the reference means 4, i.e. the counter 41 in the case shown, will give a control signal 7. Any suitable counter component fulfilling the requirements of the function can be utilized as the counter 41. The counter 41 is always either empty and filling up, or full, i.e. not full or full. The counter must be able to give a signal 7 indicating, that the counter is full. The counter 41 will be filled up with signals 3 from the pulse generator 2 only in the case, that the detecting means 5, due to a burnt-out or the like of the filament, does not continuously give resetting pulses 6. A signal "COUNTER FULL" from the counter can hence always be interpreted as an instruction 7 to replace a filament.

When the replacement means 8 for replacing a filament receives a control signal 7 from the reference means 4, i.e. from counter 41, to replace a filament the replacement means 8 switches the power supply from the filament 1*a*. . . 1*n*-1 which burned out or not working for is another reason, to a next incandescent filament 1*a*+1 . . . *n*. In the embodiment according to FIGS. 2 and 3 the filament replacement means 8 comprise a CMOS logic circuit IC3 with the reference 81, e.g. of type MC14051B. The CMOS logic circuit acts as a trigger/selector and decides when which incandescent filament 1*a*. . . 1*n* will glow. Preferably this is accomplished through switching means 9*a*. . . 9*n* specific for each filament. In the embodiment according to FIGS. 2 and 3 the filament specific switching means 9*a*. . . 9*n* comprise triac-semiconductor means T1 . . . T8 (e.g. of type 2N60773A).

In the embodiment shown in FIGS. 2 and 3 the resetting pulse circuit 51 will be controlled by the very same current 10 passing through thé filament when the lamp is lit. If no current 10 passes, i.e. if the light goes out when the lamp is connected to a fed voltage, indicating that a filament is burnt-out, no resetting pulse will come and the counter 41 (IC2) will be filled. This leads then, to start with, to a change of triac and this way to a change of filament. When a current 10 again passes through an incandescent filament, resetting pulses will continuously be originated (in every second half-cycle, i.e. 25 pulses/sec), and so the counter 41 (IC2) cannot be filled up or change the incandescent filament, but will keep the current in one and the same filament.

The number of switching means 9*a*. . . 9*n* used depends upon the number of filaments and upon the characteristics of the replacement means 8 respectively. In FIGS. 2 and 3 there is shown an embodiment having 8 incandescent filaments, at which the number of the switching triac-semiconductors 9*a*. . . 9*n* also will be 8. If the number of filaments is greater than the capacity of the replacement means 8 another replacement means with attached switching means can simply be connected after the first one. Instead of the triac-semiconductor circuit shown also other switching means can be utilized as the switching means 9*a*. . . 9*n*. According to an advantageous embodiment of the invention a special indicating means is connected to the changing means 8 in addition to the switching means 9*a*. . . 9*n*, which indicating means give an alarm outside the lamp when a certain predetermined number of filaments have burned out.

The other components shown in FIGS. 2 and 3 serve for the adaptation of the main components. The values for the adaptation components will be chosen according to the actual mains voltage, the effect of the incandescent filaments used and other such variables, respectively.

The method and arrangement according to the invention for replacing incandescent filaments can be utilized, as such, for connecting, in turn, several normal incandescent lamps with one incandescent filament. Simply, in such a case a shunted lamp will be connected instead of the lamp which has burned out.

However, a lamp arrangement with several individual lamps will need several shunted lamps, each with it own mounting socket, respectively, and hence all of the invention's advantages cannot be achieved with such an arrangement. For this reason the invention also relates to a special lamp, having several incandescent filaments 1*a*. . . 1*n* connected to the same socket 11. Thus the filaments, as shown in FIGS. 4 and 5, can be placed in one common gas space 12, i.e. all filaments can exist in a space defined by a common shell 13. Then the filaments can be arranged e.g. one above the other, as shown in FIG. 4, or in a star-like arrangement according to FIG. 5, and arrangements combining these structures can also be considered.

The incandescent filaments 1*a*. . . 1*n* can also be arranged so, that for every filament 1*i* there is a gas space closed around the filament, respectively, defined by a shell 13 being either separate or formed by a transparent isolating wall common with another filament. An advantage of a separate gas space for each filament is, that the vaporization of metal occurring in connection with any working incandescent filaments does not have any influence upon the function of other filaments. The separate gas spaces can, within the concept of the invention, be arranged in lines, in an arch, as a cluster or in any other shape, e.g. for indicating the lamp's lifetime.

In the embodiment shown all the individual filaments 1*a*. . . 1*n* are connected to a common terminal 15, but the filaments can also be interconnected in other ways so, that each individual filament 1*i* can be individually connected to work in such a manner, that the current 10 through the lamp can be detected with said detecting means 5.

I claim:

1. A method for supervising the function of incandescent filaments (1*a*. . . 1*n*) in connection with one or several incandescent lamps, which method comprises electronic controlled automatic replacement of a burnt-out filament (1*i*) by a new one (1*j*), characterized in, that pulse generating means (2) independent of the function of said incandescent filament (1*a*. . . 1*n*) are made to continually feed pulses (3) to reference means (4) having a certain storage capacity, the pulse store of which is continually emptied by signals (6) from detecting means (5) dependent on the function of said incandescent filament (1*a*. . . 1*n*), whereby any lack of such signals (6) will make said reference means (4) full, so that said reference means (4) is caused to send a command signal (7) to replacement means (8) for replacing said incandescent filament (1*a*. . . 1*n*).

2. A method according to claim 1, characterized in, that a zero voltage circuit is used as said pulse generating means (2), which circuit at every zero point in an alternate current gives a pulse to a counter (41) working as said reference means (4), and which is continuously emptied by a resetting pulse circuit (51) continuously detecting a current (10) through said incandescent filament (1*a*. . . 1*n*), whereby a discontinuance of said current (10) through said filament (1*a*. . . 1*n*) causes said counter (41) to fill up and thus to generate a signal (7) to a trigger/selector circuit (81) working as said reference means (8) for said filament (1*a*. . . 1*n*), and which in turns connects switching means (9*a*. . . 9*n*) specific for each filament.

3. A method according to claim 1 or 2, characterized in, that triac-semiconductor means are used as switching means (9*a*. . . 9*n*) specific for each filament.

4. A lamp arrangement comprising a plurality of incandescent filaments;

replacement means for selecting and triggering one of said filaments for passage of a current therethrough;

a pulse generator for emitting feed pulses independently of the operation of said filaments during passage of current through a selected filament;

detecting means for emitting resetting pulses in dependence on the passage of current through said selected filament; and reference means connected to said pulse generator to receive and store said feed pulses up to a predetermined amount, said reference means being connected to said detecting means to receive said resetting pulses for cancellation of said feed pulses stored therein, said reference means being connected to said replacement means to deliver a control signal thereto in response to storage of said predetermined amount of feed pulses for selecting another filament for passage of the current therethrough.

5. A lamp as set forth in claim 4 wherein said replacement means is a trigger selector circuit.

6. A lamp as set forth in claim 4 wherein said detecting means is a resetting pulse circuit.

7. A lamp as set forth in claim 4 wherein said reference means is a counter circuit.

8. A lamp as set forth in claim 4 which further comprises a plurality of switching means, each switching means being connected between and to said replacement means and a respective filament.

9. A lamp as set forth in claim 8 wherein each switching means is a triac-semiconductor means.

10. A lamp as set forth in claim 4 wherein said filaments are connected in parallel.

11. A lamp as set forth in claim 4 wherein said pulse generator emits said feed pulses at a rate of alternating current delivered to the selected filament.

12. A lamp as set forth in claim 11 wherein said detecting means emits said resetting pulses in every second half cycle of the current delivered to the selected filament.

13. A lamp as set forth in claim 10 further comprising a shell housing said filaments and a socket mounted said shell in gas-tight relation and housing at least said replacement means therein.

14. A circuit comprising a plurality of incandescent filaments;

a trigger selector circuit for selecting a respective one of said filaments for passage of a current therethrough;

a pulse generator for emitting feed pulses independently of the operation of said filaments during passage of current through a selected filament;

a resetting pulse circuit for emitting resetting pulses in dependence on the passage of current through said selected filament; and a counter circuit connected to said pulse generator and said resetting pulse circuit to receive said feed pulses and said resetting pulses and to store feed pulses in excess of said resetting pulses up to a predetermined amount, said counter circuit being connected to said trigger selector circuit to deliver a control signal thereto in response to said predetermined amount of feed pulses being stored for selecting another filament for passage of the current therethrough.

15. A circuit as set forth in claim 14 wherein said pulse generator emits said feed pulses at a rate of alternating current delivered to the selected filament.

16. A circuit as set forth in claim 14 wherein said resetting pulse circuit emits said resetting pulses in every second half cycle of the current delivered to the selected filament.

17. A circuit according to claim 20 wherein said pulse generator is a zero pulse generator operating on an alternating current, and said resetting circuit is connected for continuously sensing a current passing through any operating incandescent filament in such a manner, that said current simultaneously continuously causes resetting pulses to be fed to said counter circuit, whereby a discontinuance in said resetting pulses will cause said counter circuit to fill up and said control signal to be given to said trigger selector circuit for replacing a selected incandescent filament.

18. A circuit according to claim 6 wherein said trigger selector circuit comprises a CMOS logic circuit and filament specific semiconductor circuits triggered one at a time by said trigger selector circuit.

* * * * *

UNITED STATES PATENT AND TRADEMARK OFFICE

CERTIFICATE OF CORRECTION

PATENT NO. : 5,003,224

DATED : March 26, 1991

INVENTOR(S) : Jorma Hiljanen

It is certified that error appears in the above-identified patent and that said Letters Patent is hereby corrected as shown below:

Column 1, line 28 change "irretrievable, " to -irretrievably-

Column 1, line 63 change "said" to -the-

Column 2, line 27 change "the" to -a-

Signed and Sealed this

Twenty-fourth Day of November, 1992

*Attest:*

DOUGLAS B. COMER

*Attesting Officer*

*Acting Commissioner of Patents and Trademarks*